US005338255A

United States Patent [19]

Akehurst

[11] Patent Number: 5,338,255

[45] Date of Patent: Aug. 16, 1994

[54] AIR DUCT FITTING MOUNTING SHOULDER

[75] Inventor: Kenneth S. Akehurst, Castro Valley, Calif.

[73] Assignee: Noll Manufacturing Co., Richmond, Calif.

[21] Appl. No.: 7,605

[22] Filed: Jan. 22, 1993

[51] Int. Cl.[5] ..... F24F 13/06

[52] U.S. Cl. ..... 454/292; 248/27.1; 454/330

[58] Field of Search ..... 248/27.1, 343; 454/292, 454/330, 331, 332

[56] References Cited

U.S. PATENT DOCUMENTS

| | | | |
|---|---|---|---|
| 935,187 | 9/1909 | Burgess et al. | 454/331 |
| 1,225,525 | 5/1917 | Sweet | 248/27.1 X |
| 2,102,681 | 12/1937 | Curtis | 454/331 |
| 2,586,728 | 2/1952 | Shepard | 248/27 |
| 3,315,924 | 4/1967 | Greenwood | 248/27.1 |
| 3,448,452 | 6/1969 | Swanquist et al. | 248/27.1 |
| 3,815,638 | 6/1974 | Martin | 454/331 X |
| 3,866,950 | 2/1975 | Skoch et al. | 454/292 X |
| 3,985,158 | 10/1976 | Felter | 138/103 |
| 4,108,414 | 8/1978 | Grant, Sr. | 248/300 |
| 4,183,486 | 1/1980 | Esoldi | 248/27.1 |
| 4,271,751 | 6/1981 | Timmons | 454/292 |
| 4,576,349 | 3/1986 | Dearing | 248/27.1 |
| 4,673,149 | 6/1987 | Grote et al. | 248/27.1 X |

FOREIGN PATENT DOCUMENTS

| | | | |
|---|---|---|---|
| 501220 | 11/1929 | Fed. Rep. of Germany | 248/27.1 |

*Primary Examiner*—Harold Joyce

*Attorney, Agent, or Firm*—Christensen, O'Connor, Johnson & Kindness

[57] ABSTRACT

A mounting shoulder (34) attached to an air duct fitting (20) for securing an air duct register (24) over the end of the fitting. The fitting protrudes through an opening (26) in a wall member (22). The mounting shoulder comprises an attachment strip (36), a floor plate (32), and three side walls (40, 42, 44) all formed from a single plate of metal having properly placed cuts and bends. The attachment strip (36) affixes the shoulder to the fitting and is attached to the fitting such that its lower edge (52) is flush with the lower edge of the fitting. The width of the attachment strip is substantially equal to the thickness of the wall member. The floor plate, to which the air duct register may be secured, is attached along one edge to the attachment strip and lies in a plane substantially parallel to the wall member. The three side walls extend in a direction away from wall member from edges of the floor plate. The side walls provide support to the floor plate to prevent it from deflecting excessively under the application of a force in a direction away from the wall member. By using the mounting shoulder on the sides (38) of an air duct fitting, the register can be installed by threading self-drilling screws (28) through register mounting holes (30) and directly through the wall member to secure them in the shoulder. The register can also be installed by drilling holes through the wall member and shoulder and afterwards inserting screws. In either case, the register (24) can be installed securely to the fitting instead of just the wall member.

4 Claims, 4 Drawing Sheets

AIR DUCT FITTING MOUNTING SHOULDER

FIELD OF THE INVENTION

This invention relates generally to apparatus and a method for securing terminal ends of assemblies that protrude through wall members in building construction, and more particularly, to an apparatus and method for securing air duct registers to air duct fittings that protrude through openings in walls and/or ceilings.

BACKGROUND OF THE INVENTION

Air conditioning and/or heating ducts are often installed above the ceiling in buildings. The duct work leads to a fitting, which directs the air into a room. The fitting is typically secured to structures above a sheetrock (gypsum board) ceiling and protrudes through the ceiling into the room below. A register is placed over the end of the fitting after the sheetrock is in place. Most conventional registers are manufactured with two fastener holes, one at each end, to secure the register to the ceiling. If a structural member happens to be directly above one of the register holes, a screw can be driven through the hole and sheetrock, and into the structural member to secure the register in place. Otherwise, the register may only be secured by the screw in the sheetrock. This type of connection may hold for a time, but is not permanently secure. Any vibration or impact against the register will likely cause the screw to pull out of the relatively soft gypsum material comprising the sheetrock.

The problem of securing a register or other terminal end of an assembly in place is also encountered with other ceiling and wall materials. Wall and/or ceiling materials such as sheetrock, thin paneling, or plaster are simply incapable of securely holding a threaded fastener, because the materials weaken and eventually break apart or splinter over time.

Some attempts have been made in the prior art at solving this problem of securing an air duct register to a wall or ceiling. For instance, an air duct register mounting clip is disclosed in U.S. Pat. No. 4,576,349 (Dearing). The patent describes a clip that can be bent around the edges of the wall or ceiling material through which the air duct fitting passes. The register is secured in place with two screws, each of which passes through the register, the wall or ceiling, and the clip. This clip may help to distribute the load, but several problems remain. These problems include having to keep a stock of the special clips on hand when installing registers, having to pre-drill holes in the sheetrock, having to use screws sized specifically to fit the clip holes, and having to align the clips over pre-drilled holes in the sheetrock. These limitations increase the cost and time to install each register.

Related devices and methods have also been used in other applications, such as installing outlet boxes and electrical switch boxes. U.S. Pat. No. 4,108,414 (Grant) discloses an outlet box fastener that can be bent into shape. However, this fastener has most of the same limitations as the Dearing patent. It also includes the additional limitation of not being amenable to the attachment of a register after installation of the outlet box. Surface member 12 has neither a pre-drilled hole nor support for drilling a hole to accept a screw.

U.S. Pat. No. 3,315,924 (Greenwood) discloses a supported box-like structure, into which screws can be fastened, attached to the side of an outlet box. However, this structure, since it is manufactured as a box permanently affixed to the side of the outlet box, tends to get in the way during installation, particularly if it is not needed. Also, because the box-like structure permanently protrudes from the side of the outlet box, shipment and handling of the box is more difficult.

In consideration of the limitations and disadvantages of the devices and methods currently in use, it should be apparent that an effective solution to the problem of securing an air duct register to an air duct fitting through a wall member is not provided in the known prior art. Accordingly, the present invention was developed, and it provides significant advantages over previous devices or methods to secure air duct registers.

SUMMARY OF THE INVENTION

In accordance with this invention, an air duct fitting to be installed behind a wall member is provided, which includes a device for securing an air duct register. The fitting includes a receiving portion shaped to receive ducting; a rectangular outlet having four sides; and at least one plate attached to at least one side of the fitting outlet. The plate is characterized by its ability to be folded into a mounting shoulder attached to a side of the fitting. The shoulder serves as a place to secure an air duct register to the end of the fitting after the fitting is installed behind a wall member. The fitting protrudes through an opening in the wall member (i.e., wall or ceiling). The mounting shoulder comprises an attachment strip that affixes said shoulder to the air duct fitting outlet and a floor plate to which the air duct register may be secured is attached along one edge to the attachment strip. The floor plate lies in a plane substantially parallel to the wall member. The mounting shoulder also includes at least one side wall that extends upwardly from the floor plate. The side wall provides support to prevent the floor plate from excessive deflection under the application of a force used to install a threaded fastener.

In accordance with a particular aspect of this invention, the fitting and mounting shoulder are made of metal.

In accordance with another aspect of this invention, the attachment strip is spot welded to the air duct fitting such that a lower edge of the strip is flush with an edge of the air duct fitting, which protrudes into the opening in the wall member. The attachment strip has a width substantially equal to the thickness of the wall member.

In accordance with another aspect of this invention, the side wall sections comprise a forward end, a rearward end, and a front side. The forward and rearward ends have edges that abut against the air duct so as to hinder upward movement of the firm plate when an upward force is placed upon it.

This invention is also directed to a method for attaching an air duct register to an air duct fitting. The steps of the method are generally consistent with the function provided by the elements of the apparatus discussed above.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
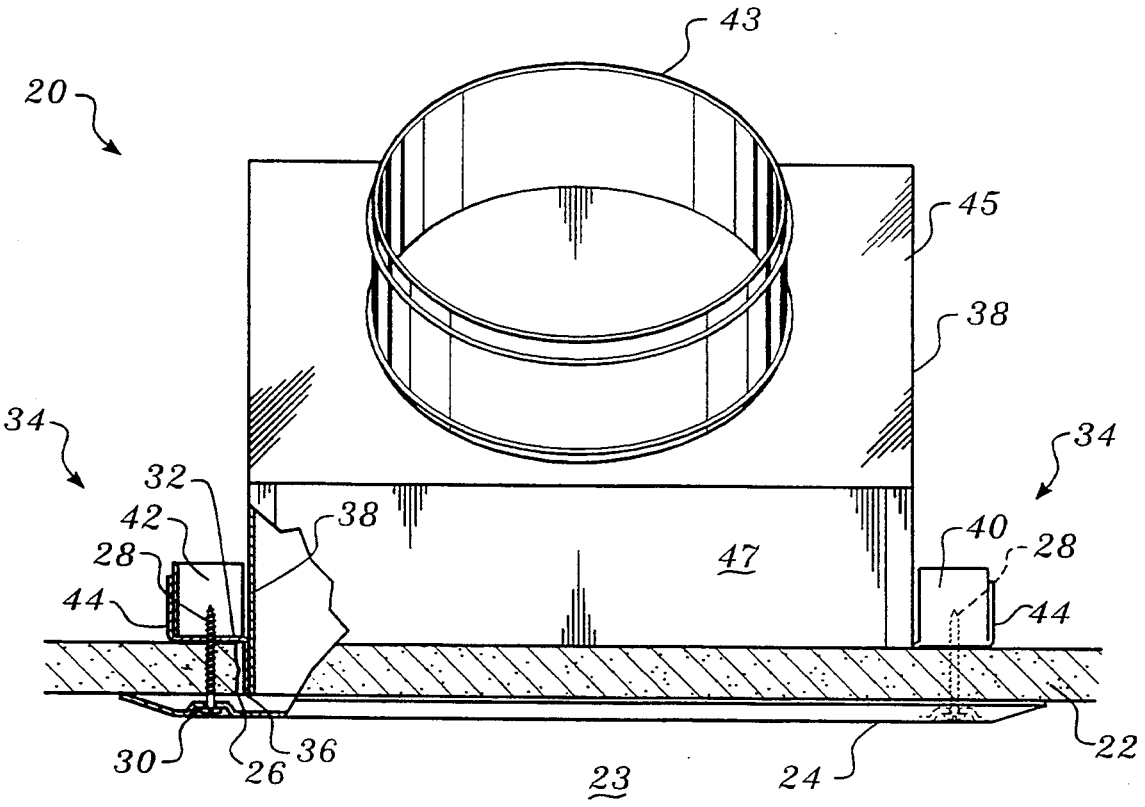
FIG. 1 is a rear elevational view of the invention, illustrating the use of the air duct mounting apparatus in a ceiling with an air duct register attached.

A preferred embodiment of the present invention is illustrated in FIG. 1. An air duct fitting 20 is shown installed in a sheetrock ceiling 22 of a room 23 with an air duct register 24 attached over an opening 26 in ceiling 22. Register 24 is secured in place by screws 28 that protrude through holes 30. One hole 30 is disposed on each end of register 24. Screws 28 protrude through holes 30, pass through ceiling 22, and are threaded into floor plates 32 of shoulders 34. Each fitting 20 has two shoulders 34, one disposed on each side so as to be located over holes 30 of register 24 when shoulders 34 are folded into shape. Shoulder 34 is attached to fitting 20, preferably by spot welding an attachment strip 36 onto an outside portion of side wall 38. Strip 36 is aligned flush with a lower edge of side wall 38. The vertical width of strip 36 is substantially equal to the thickness of ceiling 22. This width allows floor plate 32 to rest flat against a top side of ceiling 22. Shoulder 34 also includes a forward end 40, a rearward end 42, and a front side 44. Forward and rearward ends 40, 42 are disposed perpendicular to side wall 38 each having an edge adjacent side wall 38.

Fitting 20 is typically installed by attachment to structural supports before ceiling 22 is in place. At that time, the installer may fold shoulders 34 into shape if needed, as explained below and illustrated in FIGS. 4–8. One or both of shoulders 34 may not be needed if a structural member is adjacent the side or sides of fitting 20. In that case, the screw is preferably inserted into the structural member to secure register 24 in place, and the installer would not fold out shoulders 34, since they would obstruct the placement of fitting 20. Therefore, providing shoulders 34 that can be folded outwardly if needed allows for more flexibility in air duct installation.

If shoulders 34 are used to secure register 24 in place, the installer simply places register 24 over opening 26, aligns two self-boring screws in holes 30, and power drives screws 28 through ceiling 22 and floor plate 32. The upward force placed on floor plate 32 is resisted by forward and rearward ends 40, 42 pressing against side walls 38 of fitting 20. The support from ends 40, 42 and from side 44 enhances the rigidity of floor plate 32 so that it does not readily bend away from the wall member when a force acts upon it. In any case, floor plate 32 has sufficient support to resist excessive deflection under the upward force of a drill or screw during installation of register 24.

Avoidance of excessive deflection by floor plate 32 is critical. If floor plate 32 were allowed to deflect excessively under typical forces developed during installation of the register, a self-boring screw or a drill would not penetrate floor plate 32, but instead would simply deflect it away from the wall member (e.g., ceiling 22).

After installation, register 24 is held in place by the engagement of screws 28 with floor plate 32. Unlike the prior art, the screws do not simply engage ceiling 22. Screws 28 are threaded into floor plate 32. The downward load of register 24 is distributed over a large area and screws 28 are thus prevented from tearing through ceiling 22.

Figure 2:
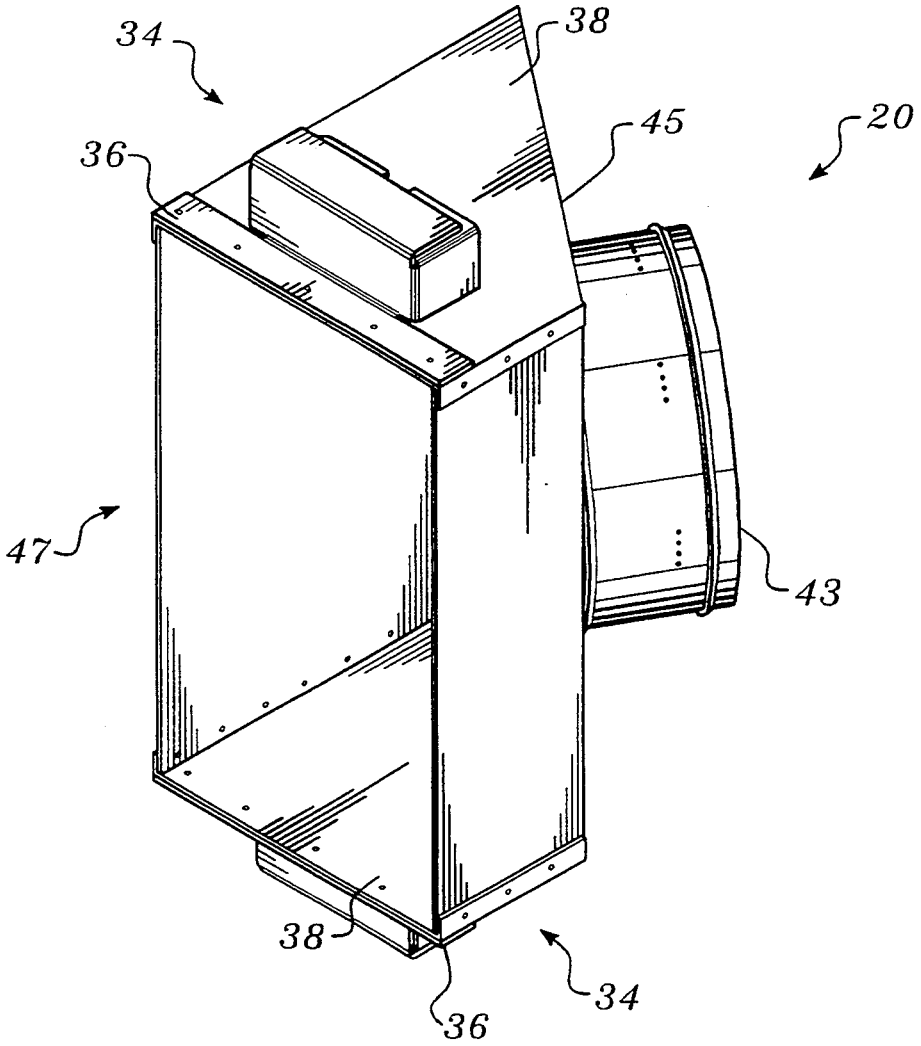
FIG. 2 is a perspective view of the invention, illustrating the configuration of the shoulder after being folded into shape and readied for use in securing a register.

Further details of the invention are more clearly shown in FIG. 2. Fitting 20 includes an air inlet 43, which engages the ducting, a wedge-shaped intermediate section 45, and an air outlet 47. Fitting 20 transforms the air flow pattern from the circular shape corresponding to the cross-sectional shape of the ducting, to a rectangular pattern matching the shape of opening 26 and register 24. Fitting 20 also channels the air from the course of the ducting above the ceiling or wall (wall member) to a direction perpendicular to the ceiling or wall so as to blow through opening 26 and register 24 into room 23 (shown in FIG. 1). It should be noted that fitting 20 shown here is a typical heating, ventilation and air conditioning (HVAC) boot onto which shoulders 34 are attached. Shoulders 34 clearly could just as well be attached to fittings of differing shapes and sizes to perform the same overall function. Shoulders 34 in FIG. 2 are shown in their folded arrangement to be used to secure register 24 (not shown in FIG. 2). Strips 36 span the width of side walls 38 and are spot welded in place, with their bottom edges flush with the bottom edges of side walls 38.

Figure 3:
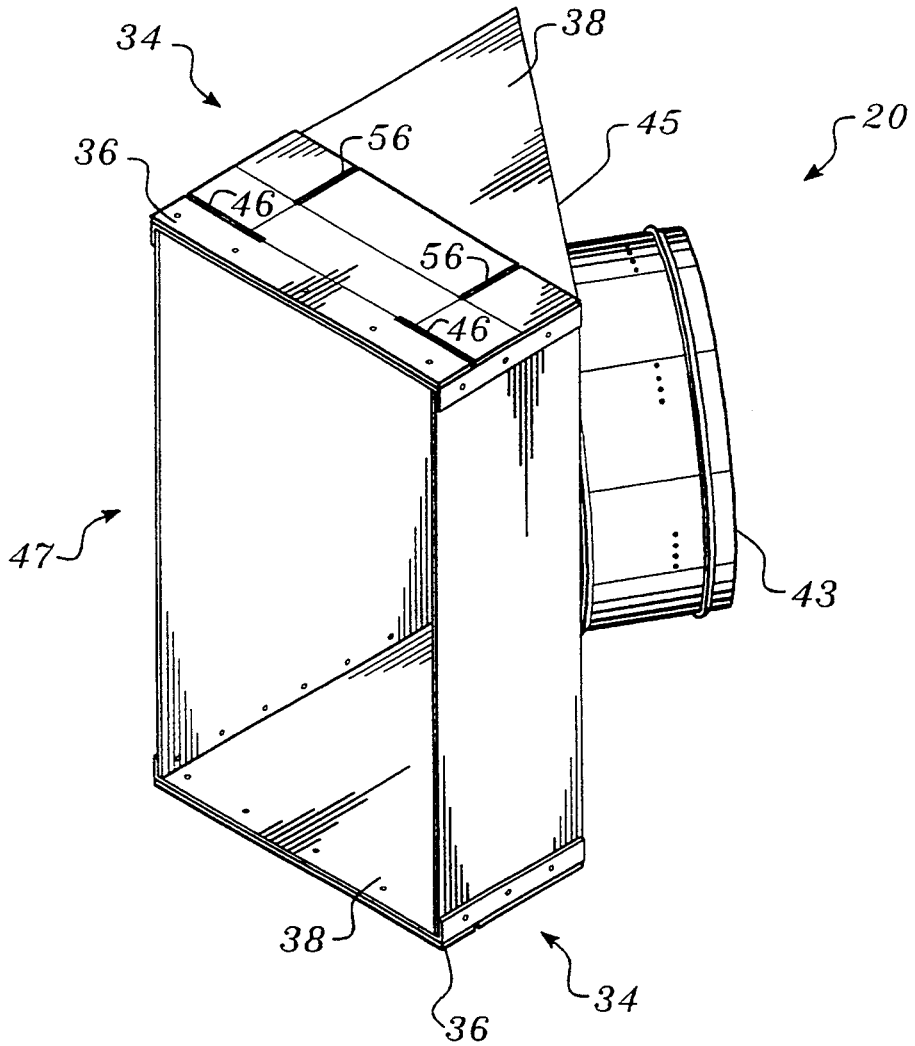
FIG. 3 is a perspective view of the invention, illustrating the configuration of the shoulder before being folded into shape for use by the installer.

FIG. 3 illustrates the configuration of shoulders 34 in plate form, before being folded outwardly. This general configuration shown in FIG. 3 is the form in which fitting 20 and shoulders 34 are preferably manufactured and distributed. It is also the configuration in which shoulders 34 remain until it is appropriate to deploy shoulders 34 outwardly to secure register 24. Because shoulders 34 rest flat against side walls 38 of fitting 20, shipment and handling of the fitting is easier and safer, the structure taking up less space and having fewer sharp edges protruding out. As discussed above, this configuration also gives the installer the option of using or not using shoulders 34. Two shoulders 34 are welded to fitting 20 on the outside of both side walls 38, to be used if needed.

FIGS. 4–8 illustrate the preferred method of folding shoulders 34 into shape. Fitting 20 has been removed from the figures to more clearly show the invention, but it should be understood that all folding shown in FIGS. 4–8 is performed after shoulders 34 have been secured to fitting 20, as shown in FIG. 3.

Figure 4:
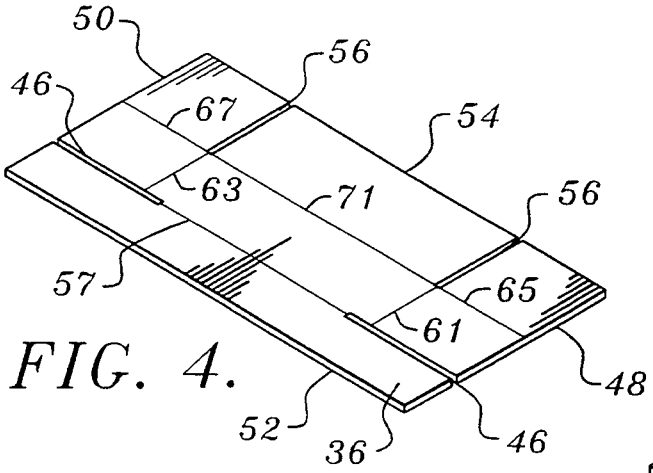
FIG. 4 is a perspective view of the plate from which the shoulder is formed before being folded.

FIG. 4 illustrates shoulder 34 in the same configuration as that shown in FIG. 3, i.e., before being folded into shape at the installation site. Shoulder 34 includes four cuts that define fold lines and sections. Preferably, grooves run along these fold lines for ease of bending the sections along the proper lines. The grooves indent the metal on the inside of the bends (the location of grooves 57, 61, 63, 65, 67, 71 are indicated by lines in FIGS. 3–7). Horizontal cuts 46 extend from a forward edge 48 and a rearward edge 50. In the preferred embodiment, each of horizontal cuts 46 extends to about one-fifth of the distance across shoulder 34. Horizontal cuts 46 run parallel to a bottom edge 52. Preferably, horizontal cuts 46 are displaced from bottom edge 52 about one-fifth of the distance to a top edge 54.

Vertical cuts 56 are cut from top edge 54 in a direction parallel to edges 48, 50. Vertical cuts 56 preferably extend into shoulder 34 about a third of the distance from top edge 54 to bottom edge 52. Vertical cuts 56 are disposed at about one-fifth of the distance from edge 48 to edge 50 and vice versa.

Figure 5:
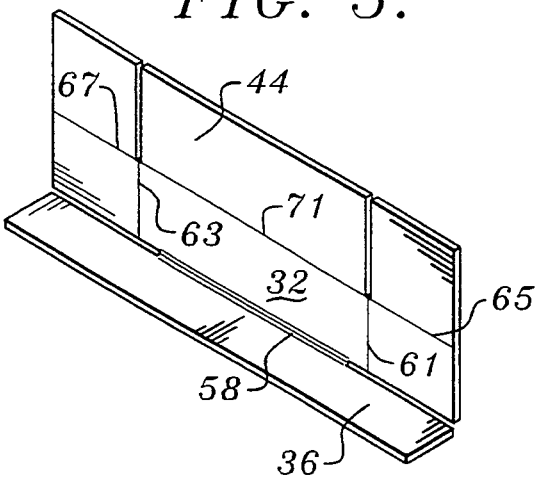
FIG. 5 is a perspective view of the shoulder after the first fold is made.

As seen in FIG. 5, a fold line is defined between the inner ends of horizontal cuts 46. A first groove 57 runs along this fold line. A first bend 58 is made along first groove 57 so that floor plate 32 and front side 44 are perpendicular to attachment strip 36. Note once again that as shoulder 34 is folded, attachment strip 36 holds shoulder 34 to fitting 20 (not shown in FIGS. 4–8).

Figure 6:
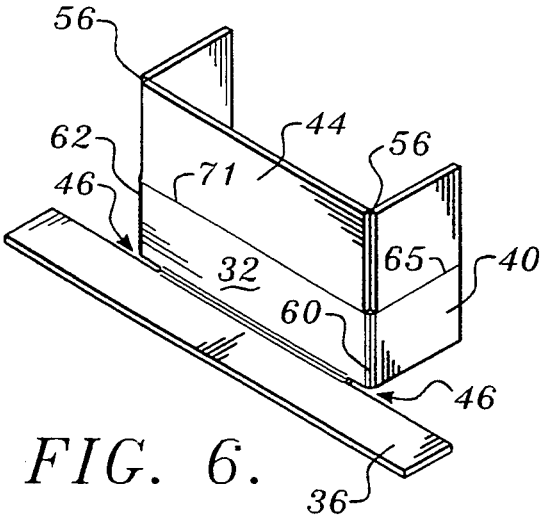
FIG. 6 is a perspective view of the shoulder after the second and third folds are made.

A second bend 60 and a third bend 62 are made along a second groove 61 and a third groove 63, respectively, that run along fold lines defined by an extension of vertical cuts 56, as shown in FIG. 6. At this point, forward and rearward ends 40, 42 are perpendicular to floor plate 32.

Figure 7:
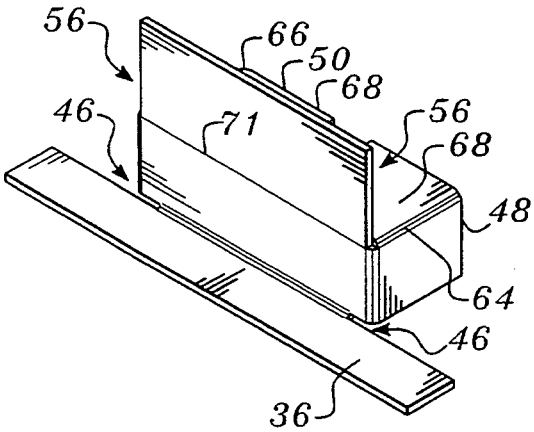
FIG. 7 is a perspective view of the shoulder after the fourth and fifth folds are made.

A fourth bend 64 and a fifth bend 66 are made along a fourth groove 65 and a fifth groove 67, respectively, that run along fold lines defined by extending a line from the ends of the vertical cuts out to edges 48, 50 in a direction perpendicular to edges 48, 50, as shown in FIG. 7. Front facing tabs 68 are thus formed in a plane parallel to attachment strip 36.

Figure 8:
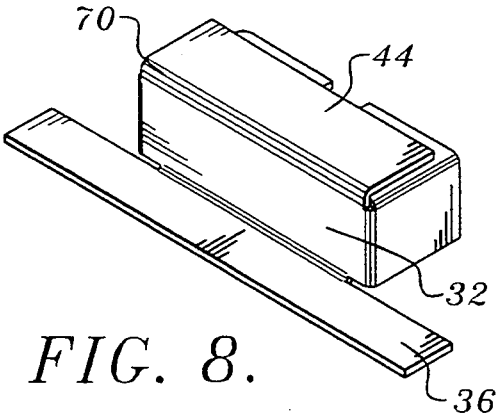
FIG. 8 is a perspective view of the shoulder after the final fold is made.

Finally, a sixth bend 70 is made along a sixth groove 71 that runs along a fold line between the inner ends of vertical cuts 56, as shown in FIG. 8. In this manner, front side 44 is made substantially perpendicular to floor plate 32. Shoulder 34 is thus formed into its useful shape.

While the preferred embodiment of the invention has been illustrated and described, it will be appreciated that various changes can be made therein without departing from the spirit and scope of the invention. For example, shoulder 34 could have a triangular cross-sectional assembled shape instead of a rectangular shape, by abutting front side 44 of shoulder 34 against side wall 38 of fitting 20 to prevent floor plate 32 from yielding upwardly. Also, fitting 20 with shoulder 34 could be mounted behind a wall instead of ceiling 22.

The embodiments of the invention in which an exclusive property or privilege is claimed are defined as follows:

1. An apparatus for securing a terminal end of an air vent assembly to a wall member, the air vent assembly including an inner portion adapted to be located at least partially behind the wall member, and a separate terminal end being disposed at least partially in front of the wall member, said apparatus comprising:

a separate generally planar plate attached to the inner portion of the assembly, the plate including an attachment section that affixes the plate to the inner portion of the assembly;

a floor section attached to the attachment section along one side and being foldable along a first fold line defined by a first set of two opposing slots extending inwardly from opposite edges of the plate, the first fold line being substantially parallel to the plane of the wall member, the floor section being adapted to be secured to the terminal end of the air vent assembly when the floor section is folded to lie in a plane approximately parallel to the wall member;

a side section attached to the floor section on a side opposite the attachment section, the side section being defined by a second set of parallel slots, the side section being adapted to be folded along a second fold line oriented substantially parallel to the first fold line and being located adjacent the inner termini of the second set of slots, to lie in a plane approximately perpendicular to the wall member; and two opposing stiffening sections located on opposite edges of the floor section and being separated from the attachment section by the first set of parallel slots, the stiffening sections being adapted to be folded along a third fold line to lie in a plane approximately perpendicular to the wall member and to provide support to the floor section to prevent the floor section from excessive deflection away from a folded position in which the floor section is approximately perpendicular to the wall member.

2. The apparatus of claim 1, wherein the plate includes a groove, extending between the first set of parallel slots to further define the first fold line.

3. The apparatus of claim 1, wherein the plate includes a groove extending at least partially across the plate approximately parallel to the attachment section between the floor section and the side section to define the second fold line.

4. The apparatus of claim 1, wherein each stiffening section includes a tab extending along one edge of the side section and being separated from the side section by the second set of parallel sots, each tab being adapted to be folded along a fourth fold line to lie in a plane parallel to the side section and to underlie the side section when the side section is in a folded position.

* * * * *